US005461893A

United States Patent [19]

Tyler

[11] Patent Number: 5,461,893

[45] Date of Patent: Oct. 31, 1995

[54] METHOD AND APPARATUS FOR BENDING STEEL RULE

[75] Inventor: Arthur W. Tyler, Newbury, N.H.

[73] Assignee: CNC Corporation, Lowell, Mass.

[21] Appl. No.: 69,614

[22] Filed: May 28, 1993

[51] Int. Cl.[6] ..... B21D 7/022; B21D 7/12

[52] U.S. Cl. ..... 72/7; 72/37; 72/294; 72/307; 72/702; 72/10

[58] Field of Search ..... 72/307, 294, 7, 72/37, 387, 388, 702, 217, 10

[56] References Cited

U.S. PATENT DOCUMENTS

| | | | |
|---|---|---|---|
| 3,145,756 | 8/1964 | Hill | 72/7 |
| 3,821,525 | 6/1974 | Eaton | 72/702 |
| 4,161,110 | 7/1979 | Ritter | 72/307 |
| 4,226,143 | 10/1980 | Whitecotton | 76/107 C |
| 4,280,350 | 7/1981 | King | 72/307 |
| 4,341,008 | 7/1982 | Graboyes | 29/467 |
| 4,397,095 | 8/1983 | Graboyes | 33/181 R |
| 4,627,255 | 12/1986 | Archer et al. | 72/10 |
| 4,772,801 | 9/1988 | Fornerod | 72/10 |
| 4,773,284 | 9/1988 | Archer | 72/307 |
| 4,947,666 | 8/1990 | Hametner | 72/702 |
| 5,187,959 | 2/1993 | Davi | 72/173 |
| 5,195,348 | 3/1993 | Del Fabro | 72/294 |

FOREIGN PATENT DOCUMENTS

| | | | |
|---|---|---|---|
| 209876 | 1/1987 | European Pat. Off. | 72/307 |
| 2235640 | 3/1991 | United Kingdom | 72/7 |

*Primary Examiner*—Daniel C. Crane
*Attorney, Agent, or Firm*—Mark P. White

[57] ABSTRACT

An apparatus and method is provided for the automated bending of continuous reels of metal strips, particularly for the bending of sharpened metal strip into steel rule dies. A sequence of steps is provided to perform a number of bends in the strip, at various positions on the strip, and of various magnitudes, in order to approximate the shape desired. Data containing the shape to be produced is introduced into a programmable computation and control system, which also contains data regarding the physical characteristics of the metal strip. An optical detection system is used to detect the shape produced at every step, and an electrical signal is fed back from the detection system into the computation and control system to compensate for any errors, particularly those errors caused by springback of the metal strip.

34 Claims, 9 Drawing Sheets

METHOD AND APPARATUS FOR BENDING STEEL RULE

FIELD OF THE INVENTION

This invention is a totally automated process and apparatus for producing steel rule dies, which are made from edge-sharpened strip metal. The dies so produced may have complex shapes, which are created as a series of two-dimensional bends, each bend being at a precise angle, and at a precise location along the length of the rule stock.

The process utilizes a system including stand-alone units designed to take reeled strip and uniformly unwind it, a drive and measuring unit which accurately tracks the motion of the strip forward and backward, and produces locational information in the form of a digital electrical signal, a dual directional bending head which bends the strip as required, a video position sensing unit which precisely determines the shape of the die as it exits from the bending head, a cutoff shear and notcher which cuts the die components to final size, and finally, a computation and control system which synchronizes the entire operation.

The collection of separable units are integrated, and the process is controlled by the programmable computation and control system, which contains a data bank having information on the specific elastic response of the current spool of rule and/or generalized elasticity data. This data is used to predict the correction required in making each bend, in order to take into account the spring back, or hysterisis, of the material.

In addition to the prediction information from the data bank, the video position sensing unit determines the exact shape of the bend after it is made, and produces an electrical signal containing this information, which is fed into the computation and control system. The computation and control system calculates the variations between the actual shape and the desired shape, and issues a control signal to modify the next bend accordingly.

BACKGROUND

Steel rule dies are used in cutting many of the fabricated items we take for granted. The materials cut by dies range from soft metals and tough plastics through foams, leathers, and cloth, to frail films, papers and even food items. The end products of this type of die cutting include thick foam cushions, shoe parts, decals, metal foil trays, and bakeware.

Essentially any product that can be produced in sheet form may be cut with steel rule dies. Other similar die types, such as clickers, can be made with the same methods as steel rule dies, although the die material may be slightly different.

These dies have evolved from the blacksmith's dies of heavy wide strip which were sharpened on one edge and hammered into leather goods. Today, however, steel rule dies have become a specialized industry. The shapes of these dies are often relatively sophisticated, and made from thin rule stock, which is specially treated steel strip that is flexible, yet holds its sharpened edge. The dies are formed and then placed into holding matrices such as slotted plywood or cast polymers. Steel plates may be added to distribute press forces onto the holding matrices.

The steel rule industry is presently estimated to produce revenues of between four hundred million and six hundred million dollars per year. The annual production of about one hundred twenty-two million feet of rule, at an average cost of between thirty-four cents and thirty-eight cents per foot, represents about forty-four million dollars of this total. It is further estimated that at least thirty-five percent of the total footage of steel rule produced is turned into scrap, as a result of the methods currently used to manufacture the dies.

The formed steel rule dies are usually either pressed into laser cut grooves or into intricately sawn slots in a plywood base, and must be formed to fit the slots. The alignment of parts by mere use of the slots as guides is rarely successful if the shape of the rule is not pre-formed to conform to the shape of the slots. In addition, a frequently used technique provides for frequent lands in the plywood parts that hold the centers of cutouts within the die frames. The lands are accommodated by cutting matching notches into the steel strip so that the strip goes over the lands without making contact.

The dies are made from any of a series of specialty steels. The stock is formed into a coiled strip and then sharpened on one edge of the strip. The coils are difficult to handle, so the strips are usually supplied in a flat cutoff form. The die is constructed from one or more sections of this strip and may be bent at various sharp angles, or into gradual curves, or used as straight sections, depending on the desired shape. While the use of steel rule dies is not the only way to make repetitive and essentially identical cut shapes, such use constitutes one of the lowest cost and most popular methods.

The steel rule dies are made by bending strips of the edge-sharpened steel into the required intricate shapes. The formed strip is then attached to a backing that permits pressure to be applied by a press or powered stamping machine to cut out the materials. The bending is sometimes done by hand, or, at other times by machine. Regardless of the method of manufacture, making the bends requires the skill of experienced artisans because the steel strip, as it is bent, tends to spring back, due to the elastic properties of steel.

Within the range of elastic response, prior to the yield point where a deformation becomes permanent, there is considerable spring back whenever a bend is made. The experienced bender must estimate the amount of spring back or spring back (terms used interchangeably herein) and overbend the strip by an appropriate amount to accommodate for the spring back.

In the operator-based system now in use, the operator must anticipate the memory of the steel strips and overbend each change in direction so that when the steel memory causes a spring back to occur, the spring back is just the right amount to make the desired final shape. This overbending by "feel" is rarely perfect. Minor problems can often be cured by forcing the strip into the cut grooves in the plywood backing support, but the cumulative effect of errors on complex shapes can deform the die so that it no longer fits the grooves. As a result, there may be a loss of materials and labor.

Thus, the manual approach to making steel rule dies requires well trained and experienced operators, who usually command relatively high pay. Furthermore, the time required for manual production of steel rule dies is exorbitant.

Automation of this process by automatic bending machines has been an especially difficult problem for designers. This difficulty is due to the high variability of steel rule resulting in a wide range of spring back memory from lot to lot. Such a bending machine would have to be calibrated for every lot of steel strip used, and a new spring back algorithm created for each and every lot. Further complicating the process is the fact that the properties of rule may vary within a single lot of steel strip manufactured.

Thus, there is a need for a steel rule die manufacturing method that is relatively independent of the spring back variations, and which can control these variations so that bends remain highly accurate. Until now, such a method has not been available.

There is an additional complication in die manufacture. Even if the strip properties are compensated for by a machine, the properties for an initial bend are different than the bending properties of a strip bend corrected by a second bend at the same place. This secondary bend or correction of bend also must be compensated for.

There is also a need to reduce waste in the rule bending process. When the strip or rule is delivered in short, easy-to-handle lengths there is a high amount of waste, since the initial portion and tail ends of each strip are often discarded. Up to 40% of each precut strip is wasted in bending, since the strips are only partially used, or the die manufacture requires a front grip area and a rear grip area that becomes waste. As noted above, the memory or spring back also creates waste. There is a need for a bending process that can exactly replicate a form or at least create a duplicate where the incremental steps in bending approach the exact duplication of the original form.

At present the problems noted above are major ones that prevent effective and exact steel rule die manufacture and further prevent the automation of this manufacture, although there have been several attempts to overcome these problems.

One such attempt is the BBS-101 & caddie made by Tsukatani Blade Manufacturing Co., Ltd. of Osaka, Japan. In this machine a massive memory of blade material properties is stored in the machine's computer memory. Each machine is individually calibrated against these data files to provide a predictable calculation of the amount of bend required. The scale of the required bending and the localized and individual lot properties of the steel are not accounted for, however. As a result, the bend accuracy is not good since there are springback fluctuations in the blade strip materials that are not taken into account. Other problems include stretching or compression of the strip in bends, jaw slippage, and the fact that the radius of the bends is restricted by a head design that has fingers which slide on the perimeter of a round grip bar. This feature precludes bends being spaced closely together, bends smaller than the round grip bar, or larger than a factor of 1.3 times the grip bar radius.

As a result, this machine can make only 50 to 60% of the simpler needed bends.

Another approach is describe in Archer et al., U.S. Pat. No. 4,627,255, Dec. 9, 1986. This patent describes a system in which the steel rule is passed through a bending head, and an electrical contact used to sense when the rule is no longer in contact with the bending head, and thus provides a rough measure of the resulting shape of the die so far. However, this device does not provide a precise method for measuring the die shape produced at this stage of the process. This invention furthermore does not withdraw the bending head at the point of cutoff, thus requiring trimming of the finished die, with resulting excessive scrap.

Other prior art includes a patent by Graboyes, describing a method for registering steel rule dies where registration holes are used, not in the forming, but for registration within a cutter (U.S. Pat. No. 4,341,008). Registration within a cutter is also noted in U.S. Pat. No. 4,397,095, but not the registration and alignment of bends in making dies.

Another Patent, for a Method of Making Steel Rule Type Piercing and Blanking Dies, issued to Whitecotton et al. (U.S. Pat. No. 4,226,143) is representative of the present state of the art. This method uses a punch die blank that is covered with a tape layer that allows a clearance distance. The steel rule elements are assembled against the punch die blank, so that the shape of the punch blank is accurately maintained. Repetitive dies can be accurately made with this method, but the method does not address the bending or creation of complex steel rule dies.

The prior art also contains a number of wire benders. These devices are designed to handle either wire ends in electrical/electronic assembly operations (which have little in common with the diverse requirements of a strip bending) or they are designed to bend wire shapes. They are generally not applicable to the current application.

SUMMARY OF THE INVENTION

A general object of the current invention is to provide an effective, economical, automated means of producing steel rule dies from a continuous coil of raw material.

A specific object of the current invention is to reduce the high amount waste that is now common in die manufacture. A second specific object of the current invention is to provide an accurate, repeatable method of die manufacture, which automatically compensates for differences in the physical characteristics between different lots of the steel rule stock from which the dies are made, and for inaccuracies in the machine construction.

The invention does away with the necessity for the repeated test and correction techniques currently incorporated in steel die manufacture. It further dispenses with the need for highly skilled operators to perform said test and corrective techniques.

The invention accomplishes these objectives by the use of responsive bending techniques which repeatedly make an incremental bend and then automatically examine the results, thereafter correcting the next portion of the bend to compensate for the accumulated error.

One aspect of the current invention provides for the bending of the steel rule in two directions with a single bending head, thus lowering equipment costs and complexity.

Another aspect of the invention allows a variety of notches to be made along the strip, and cutoffs to be made near bends, thus minimizing the scrap which would otherwise be produced.

Yet another aspect of the invention produces mitered corners when needed.

The process of making steel rule dies disclosed in this invention involves the use of a bending head which includes a single small-diameter mandrel which is used to distort the steel rule strips by the application of force on the protruding portion of the strip while it is firmly gripped in a holding jaw. The single mandrel has a bending shaft and mounting device that allows the withdrawal of the mandrel and holding jaws, rotation of the mandrel, either concentrically or eccentrically, and reinsertion, with the mandrel, on the other side of the steel rule strip, thus allowing a single head to bend the strip in either direction from the holding jaw.

By the use of this technique, dies of complex shapes may be produced as a series of individual bends. Thus dies may be produced whose shape is able to closely approximate a gradual curve, even a curve that may change in radius.

Yet another aspect of the invention is the inclusion of an optical sensing system which detects the shape of the portions of the die as these portions exit from the bending head. This optical sensing system provides an electrical signal, which contains precise position and shape information, and which is either digital in nature, or which is further processed to produce a digital signal.

Yet another aspect of the invention is the inclusion of a cutoff and notching die which allows a notch to be cut in the strip to a depth which can be varied by moving the die in a direction perpendicular to the length of the strip, and to a width which can be varied by cutting repeated, overlapping notches by moving the strip in the direction of its length.

A final aspect of the invention is the master computation and control system (hereinafter CCS) which synchronizes the operation of the entire process. First of all, information describing the shape to be created is fed into the CCS. During each step of the operation of the system, the CCS reads the digital signal output from the optical sensor, and calculates the precise shape of the die as it currently exists, as a result of the accumulation of the bends made so far. The CCS then computes the difference between the actual shape of the die so far, and the desired shape, and calculates the parameters of the next bend thereby. Finally, the CCS outputs the command signal to the bending head which creates the next bend.

The feedback process described above is thus repeatedly executed, until the final bend is made, after which the bending head is withdrawn and the steel rule stock is cut off by a cutting tool. It is thought that the withdrawal of the bending head allows the cutting tool to make its final cut closer to the final bend than was possible in the prior art.

DESCRIPTION OF DRAWINGS

These, and further features of the invention, may be better understood with reference to the accompanying specification and drawing depicting the preferred embodiment, in which:

FIGS. 3A and 3B depict details of the notching-cutting die, wherein FIG. 3A depicts a cross section of the notching-cutting die, and FIG. 3B shows a plan view of the die.

FIG. 4A shows the first step in the bending procedure, FIG. 4B shows the second step, etc.

DETAILED DESCRIPTION—PREFERRED EMBODIMENTS

Figure 7:
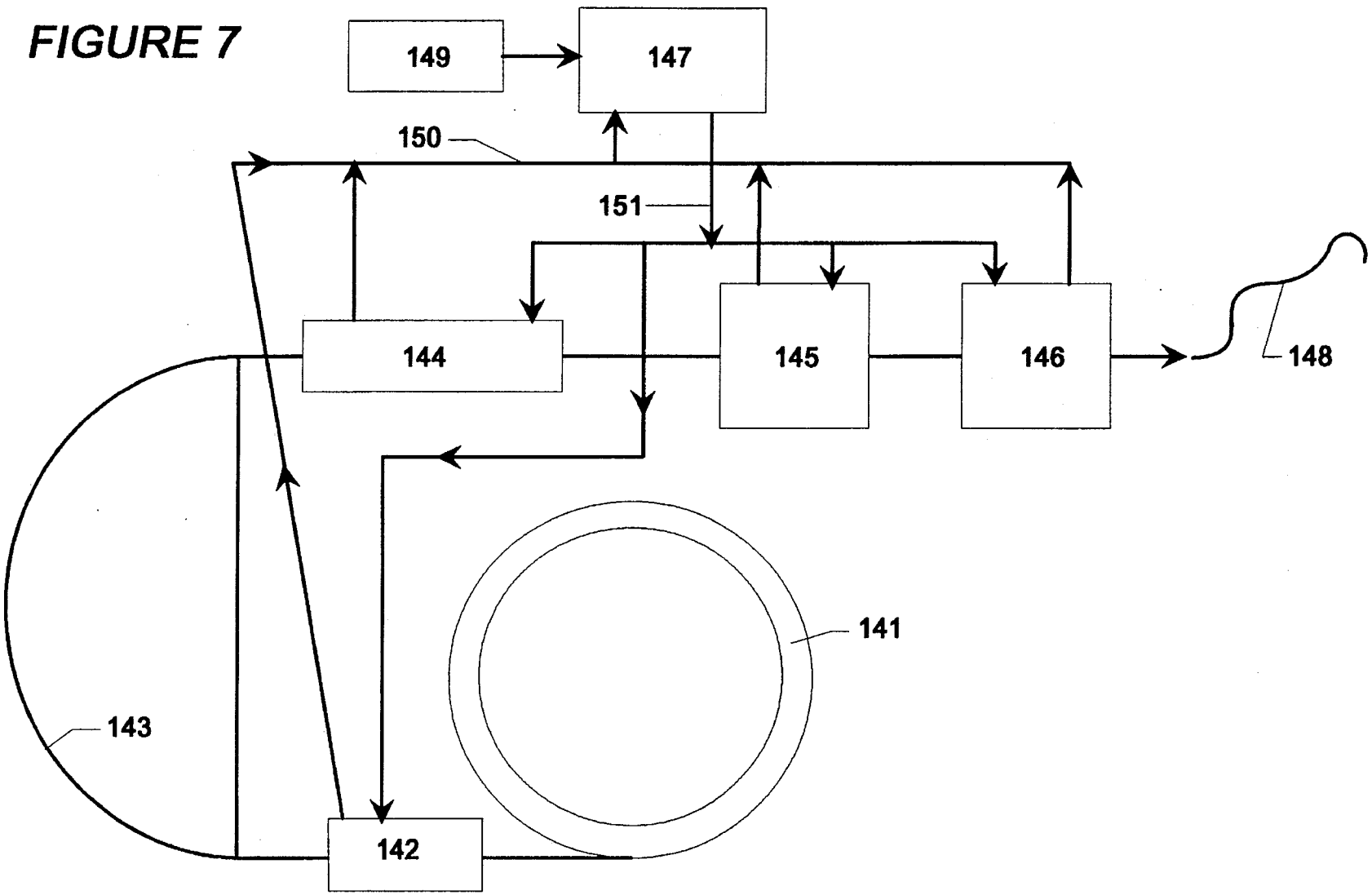
FIG. 7 depicts a functional diagram of the entire mechanism, illustrating the interaction between the various components of the system.

The preferred embodiment of the invention feeds, notches and bends steel rule stock, commonly called rule. The rule typically has one edge sharpened. The invention in the most preferred embodiment is comprised of three sections, a rule feeder, a notcher/cutter and a bender. FIG. 7 is a block diagram of the machine. The feeder includes an input coil of steel rule 141, an auxiliary feed mechanism 142, which extracts rule from the coil and moves it through a semi-circular buffer chamber 143 to a main drive mechanism 144 which controls the motion of the rule through a notcher/cutter 145 and a bender 146. All of the machine components operate under the direction of computer controller 147 causing them to interact to produce die segment 148 with a prescribed shape. The controller receives information via a computer disk or some comparable means generally from a CAD file 149 prepared in advance by a host computer. The CAD file contains all of the information relating to the specific die and usually to all dies that have been made previously. This CAD file is also used for other purposes such as preparing the base into which the rule segments will be inserted. The computer also receives information on input channel 150 from various sensors (not shown) at strategic locations within each machine component. These sensors generally are metallic proximity sensors or optical beam interruption sensors which detect the presence of the steel rule or of various moving parts of the machine. The computer delivers control signals via output channel 151 to various driving elements located within the machine components usually air cylinders, digital stepper motors or digital servo motors. The software required to control the machine includes a variety of routines well known in the trade linked together to perform the specific sequences needed. The arrangement of components shown is the preferred sequence but other arrangements are clearly possible including the use of any component separately or in other combinations.

Rule Feeder

Figure 1:
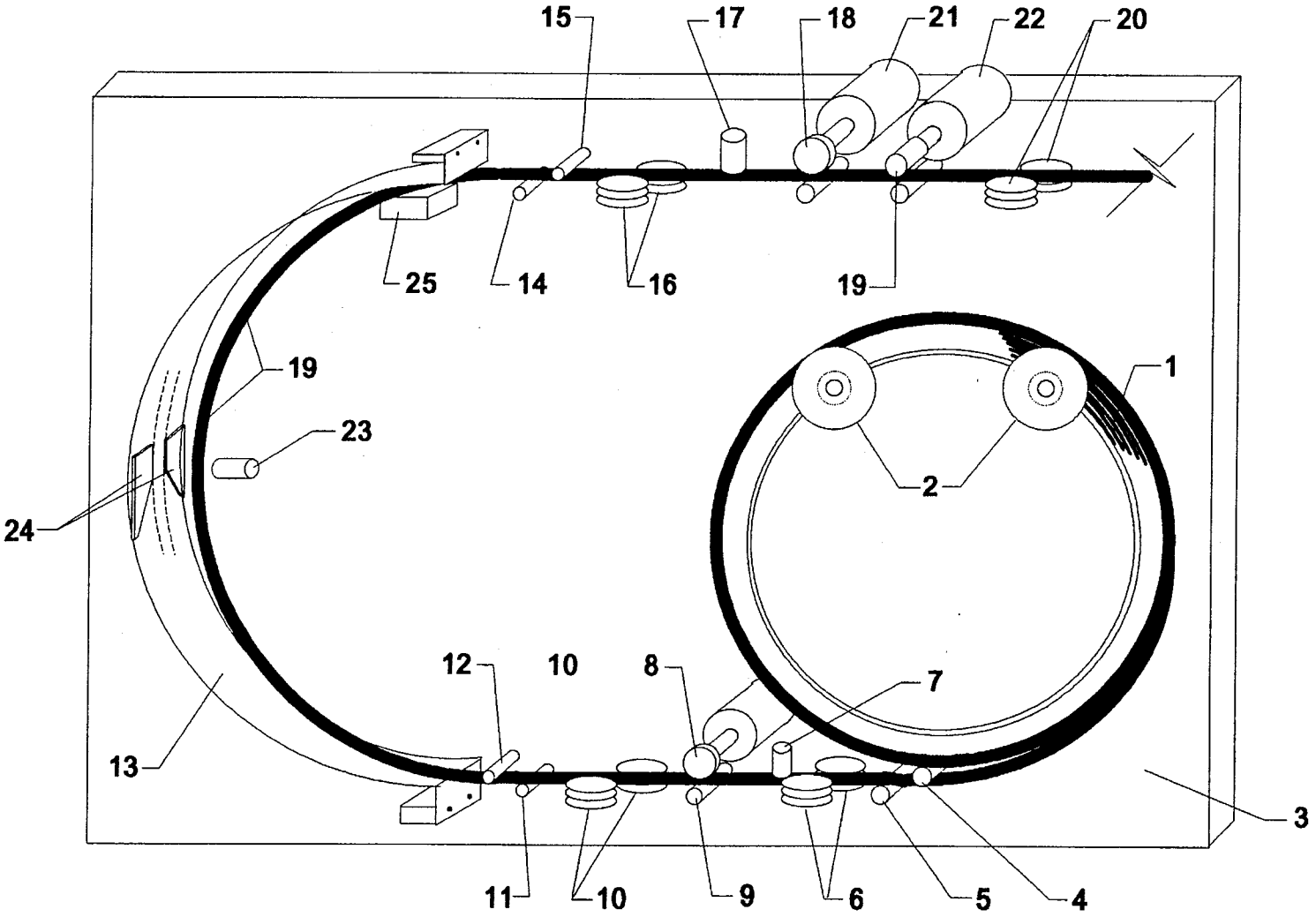
FIG. 1 depicts the structure of the feed mechanism.

The preferred embodiment of the feeder can be explained by reference to FIG. 1. A coil of steel rule material 1, nominally but not limited to 300 feet in length, is hanging freely on two flanged rollers 2 rotatably mounted on a suitable baseplate 3. The rule unwinding downward passes under roller 4 and thence over roller 5 which relieves the coiling stress and directs the rule along a horizontal path. It then passes through an auxiliary feed mechanism including a pair of edge guide rollers 6, a sensor 7, an auxiliary motorized feed roller 8 with an associated spring loaded pressure roller 9 and a second pair of edge guide rollers 10. The edge guide rollers restrain the rule in two dimensions but permit it to move freely in substantially a straight line in the third dimension thereby enabling the feed roller to move the rule forward or backward readily as required. The edge guide rollers engage the rule with a V-shaped groove shaped in such a manner that it does not touch the sharp edge of the rule which might otherwise suffer damage. The rule then passes through a semi-circular buffer chamber including outer stress relief roller 11, inner stress relief roller 12, semi-circular retaining wall 13, inner stress relief roller 14 and outer stress relief roller 15 following which it is traveling again along a horizontal path above the previous path and in the opposite direction.

The rule now passes into the main drive mechanism including a pair of edge guide rollers 16, sensor 17, measuring roller 18 coupled to digital encoder 21, main drive roller 19, and a second pair of edge guide rollers 20. This section is similar to the auxiliary feed mechanism but differs in several important respects. As will be described in more detail in later paragraphs the main drive must move the rule both forwards and backwards with maximum precision. The feed drive on the other hand is merely a slave to the main drive to relieve it of as much friction and inertia load as possible particularly that of the supply coil. The main drive motor, preferably a digital stepper or digital servo, is a high performance motor with good angular resolution and ample power to drive the rule without slippage. Such motors are well known in the trade. In addition to the motor there is a highly accurate motion measuring device preferably a high resolution rotary digital encoder 21 driven by measuring roller 18. The encoder senses the actual motion of the rule independently of slippage of the drive roller or other factors external to the measuring system. The auxiliary feed motor, preferably a digitally controlled stepper or servo, in contrast to the main drive motor, requires sufficient power to handle the load of the coil but only with nominal accuracy.

The motion of the main drive is dictated by the control computer to meet the requirements of some specific processing cycle. In general the motion will be intermittent and both forward & backward but always a net amount forward. The feed drive in the meantime is either stationary or moving forward at a slower velocity. These motions cause the rule to pull away from the retaining wall 13 and assume the shape of a free loop 19 restrained only by stress relief rollers 11, 12, 14 and 15. When this loop reaches a specified minimum size it is detected by sensor 23 causing the auxiliary feed motor to advance the rule by a selected amount to enlarge the loop. The reaction of the feed motor can be programmed in various ways by anyone familiar with the art but the net result is to maintain a loop size always larger than the minimum but never large enough to contact retaining wall 13.

Retaining wall 13 is functional only during the initial loading of the coil of rule as a means of guiding the rule automatically through this part of the device and as a protective shield. During the loading procedure an operator places the coil on flanged rollers 2 and inserts the free end of the rule under roller 4, over roller 5, through the grooves of edge guide rollers 6 and against feed roller 9. The auxiliary feed motor becomes energized when the rule is detected by sensor 7 advancing the rule around retaining wall 13. The lateral motion of the rule tends to be unstable as it moves around retaining wall 13. Sloping side guides 24 located near the midpoint of retaining wall 13 restore the rule to a central location as the leading end passes by and similar sloping side guides 25 bring the rule to an approximate center line enabling it to enter the V-grooves of edge guide rollers 16. The main drive motor is alerted when the rule reaches sensor 17 and activated when the measuring encoder detects rule motion. After a brief transition sequence the feed motor stops and the drive motor advances a nominal amount to form free loop 19. The dimensions and location of side guides 24 and 25 as well as retaining wall 13 are such that the rule does not touch them after loading is completed. Sensor 7 also serves as a warning that the coil is exhausted and only a few feet of rule are available. Likewise sensor 17 detects the end of the rule and shuts down the main drive.

It also may be necessary to remove a partially used coil of rule and replace it with a different type of rule. This is readily accomplished simply by reversing both motors at some convenient speed while the operator moves the coil manually to rewind. Optionally, a torque motor could be attached to one of the flanged rollers 2 to assist in this operation.

Notcher/Cutter

The second section of the machine is devoted to cutting notches in the rule and to cutting the rule to an accurate length. Its operation can best be understood by reference to FIG. 2. Notches are cut out of the rule at selected locations prior to bending. Cutting to length, however, is the final operation to be performed. The rule must first be moved forward or backward to position the desired end point at the cutter. Oftentimes, the cut may be close to the final bend. These conditions dictate that the outlet side of the cutter which is adjacent to the bender should be as open as possible to avoid interference with rule sections bent into complex two-dimensional shapes. The cutter must be narrow and shallow. As a result of this requirement a shearing device as opposed to a punch is the preferred embodiment of this invention. A female die 31 is mounted on a rigid base 32 which in turn is mounted on the carriage of slide 33 movable transversely relative to the rule by motor 48 in order to select the notching or cutting operation. A mating punch 34 is attached to the lower surface of arm 35 rotatable around bearing 36 on base 32. A second arm 37 rotatable around bearing 38 also located on base 32 is coupled to arm 35 by a link 39. This double lever arrangement provides a substantial mechanical advantage to reduce the force applied at the outer end of arm 37 to operate the shear while still retaining a satisfactory shear angle. The nut 41 of ball screw 42 is pivotally connected to the end of arm 37. The supporting bearing 43 for ball screw 42 is mounted on plate 44 pivotally attached to base 32. The shear is activated by motor 45, preferably a digital stepper or digital servo, coupled to ball screw 42 by a timing belt and pulleys 46 selected to reduce the motor torque requirement still further. This combination of levers, ballscrew and pulleys reduces the torque to a level easily supplied by a small stepper.

Figure 3B:
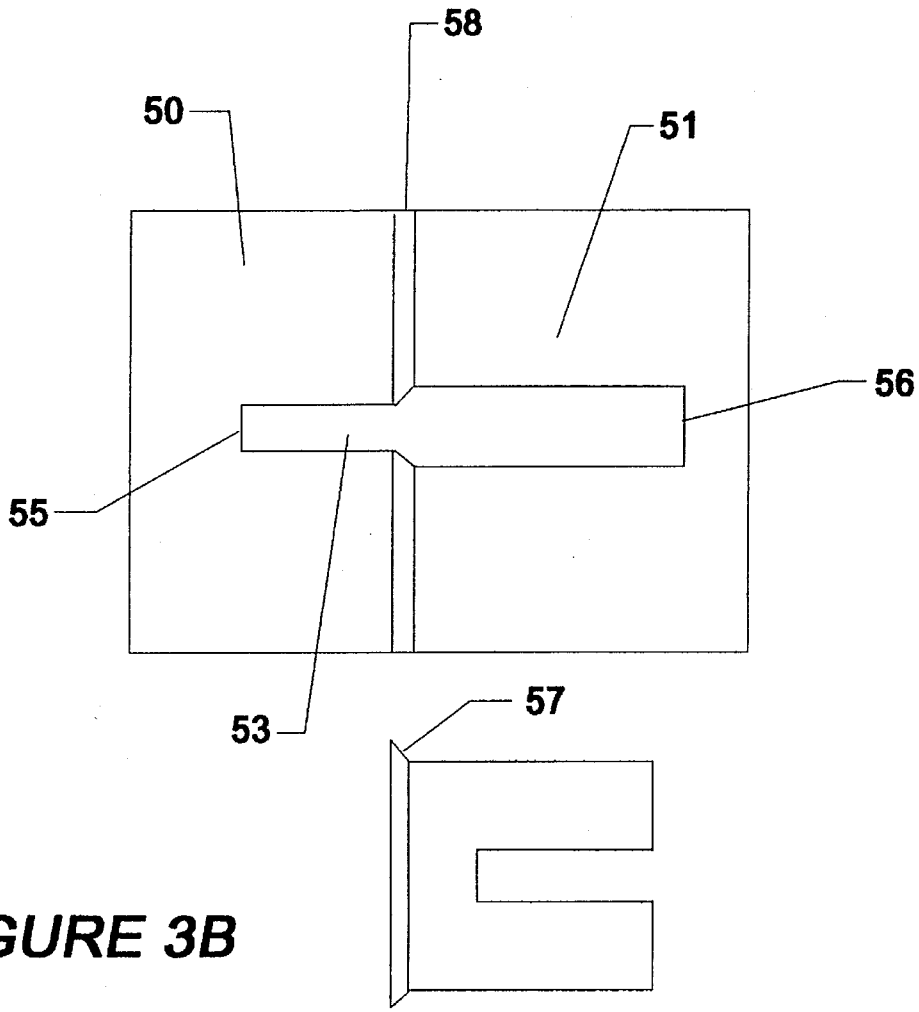
Figure 3A:
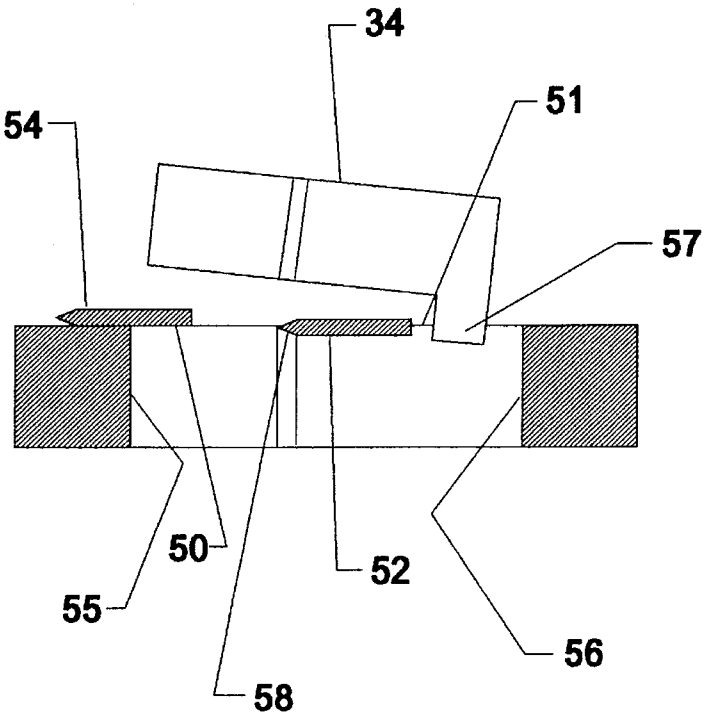

The cavity of die 31 (shown in cross section in FIG. 3A) has an upper level 50 and a lower level 51 with a sloping region 58 at the boundary matching the slope of the cutting edge of rule 52 shown in the cutoff position thereby supporting it firmly along the cutting edge. As illustrated in FIG. 3B which is a top view of die 31, die cavity 53 also slopes outward as well as downward at the boundary region in order to achieve a cutoff with a mitered edge 57 matching the cross-sectional shape of the rule and permitting the cut end to abut the side of another piece of rule, to form a T-shaped pattern, without a gap in the cutting pattern. Used herein, mitered means a projection of one edge of the rule as opposed to an angular cut across the full width. When the shearing mechanism is moved laterally to the notching location the rule is at location 54 on the upper level 50 of die 31. Punch 34 now descends to initiate shearing action at the edge of the rule progressing across the rule to the end 55 of the cavity where the final action severs the notch as a punching action. Because of the smooth motor-driven motion and the relatively slow cutting speed compared to a usual punching speed both notching and cutting are relatively quiet and free of shock vibrations.

The lower level 51 of cavity 53 extends a short distance beyond the rule so no cutting takes place at end 56 of the cavity. A protruding tab 57 of punch 34 extends into this section of cavity 53 at all times thereby providing a guide for the punch as it descends. This feature makes the initial alignment of punch and die relatively simple and virtually eliminates the danger of punch and die interferences.

Figure 2:
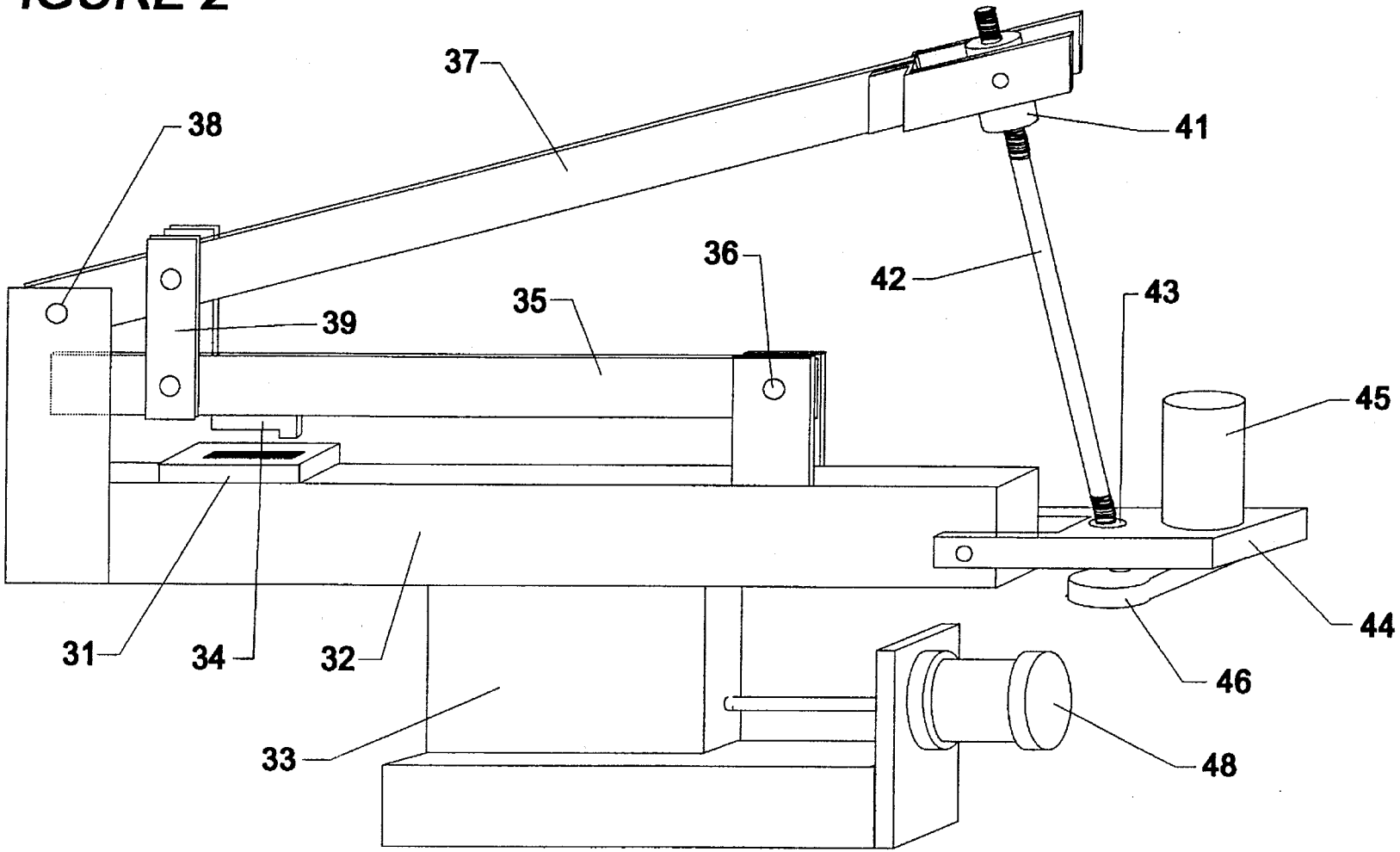
FIG. 2 depicts notcher-cutter mechanism.

Slide 33 shown in FIG. 2 is preferably driven by a digital stepper motor or digital servo motor 48 in order to move the shearing mechanism to any location specified by the system controller. This feature enables the cutting operation to be performed away from the sloping region of the cavity producing a straight cut rather than a mitered cut. The controlled motion also enables the depth of the notch to be adjusted to any selected value. In addition the width of the notch can be varied from a minimum dictated by the width of the cavity 53 to any larger value by multiple notching operations with a suitable movement of either the rule or the die. All of the above is accomplished by computer control only, not requiring any mechanical adjustments.

Bender

Figure 4A:
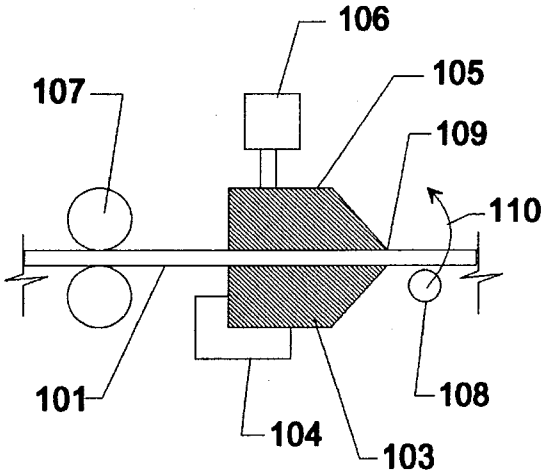
FIGS. 4A, 4B, 4C, 4D, 4E, and 4F depict the bending procedure, in which subsequent steps in the bending sequence are shown, as the steel rule passes through the feed rollers, into the gripping jaws, and past the bending mandrel.
Figure 4B:
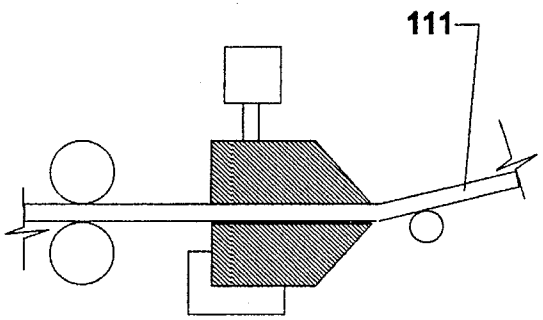

The final section of the machine is the mechanism for bending the rule. The principle used for the bending procedure is illustrated in FIG. 4. FIG. 4A shows the situation before the first bend. Rule 101 passes through a clamping device comprised of a stationary bar 103 adjacent to a rigid support 104 and a moveable bar 105 driven by an actuator 106, preferably an air cylinder. When actuator 106 is energized it forces moveable bar 105 against rule 101 clamping it firmly against stationary bar 103. When actuator 106 is released rule 101 can be moved freely between bars 103 and 105 by the main drive assembly of the feed mechanism. A bending tool 108 extending across the full width of rule 101 is rotatably mounted with its axis of rotation substantially coincident with the exit aperture 109 of the clamp mechanism. Bending tool 108, preferably in the form of a rod of some suitable shape, is mounted parallel to, but a nominal short distance away from exit aperture 109 enabling it to be rotated along the arc 110 pressing against rule 101 and deforming it by a precalculated amount to position 111 shown in FIG. 4B. Bending tool 108 is then rotated in reverse to its former position whereby rule 101 springs back slightly from position 111 to position 112 illustrated in FIG. 4C. Actuator 106 is then released enabling rule 101 to be moved forward to position 113 shown in FIG. 4D. If the sequence of steps illustrated by FIGS. 4A to 4D are repeated several times rule 101 has the shape shown in FIG. 4E including a series of small bends each separated by a nominal distance. This shape can be made to approximate a circle of arbitrary radius within any specified tolerance by proper selection of the angle of each bend and the distance between them. Furthermore, if the angle and distance parameters are varied from step to step a compound curve of variable radius can be formed.

Figure 4C:
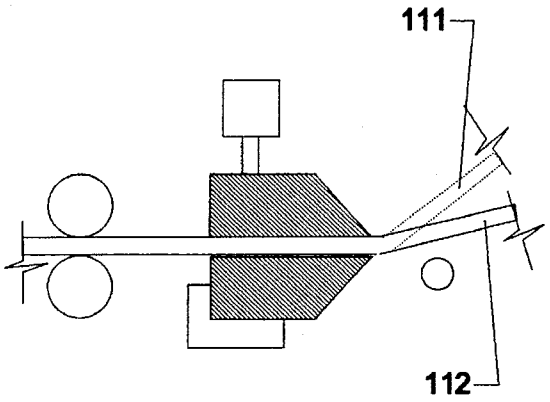
Figure 4D:
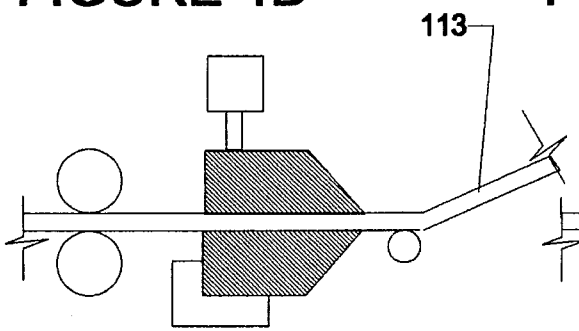
Figure 4E:
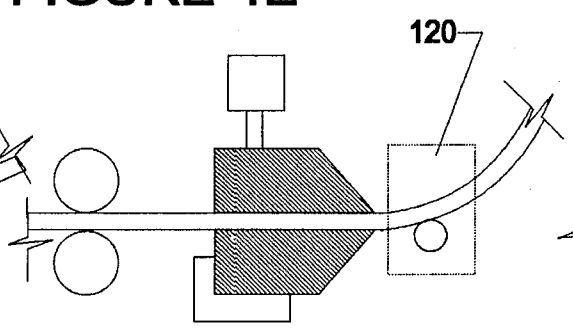
Figure 4F:
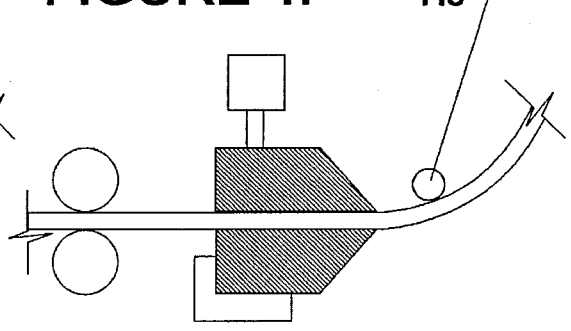

As illustrated in FIG. 4C, the bent rule tends to spring back somewhat when the bending tool moves away. The amount of spring back depends on the characteristics of the rule material, the angle of bend, and the dimensions of the bending mechanism. An overbending procedure can be used to compensate for most of the spring back. A table of data listing the measured spring back for all angles, materials, and tools is preferably prepared in advance and used for this purpose. This procedure reduces the spring back error but does not eliminate it completely.

Figure 5:
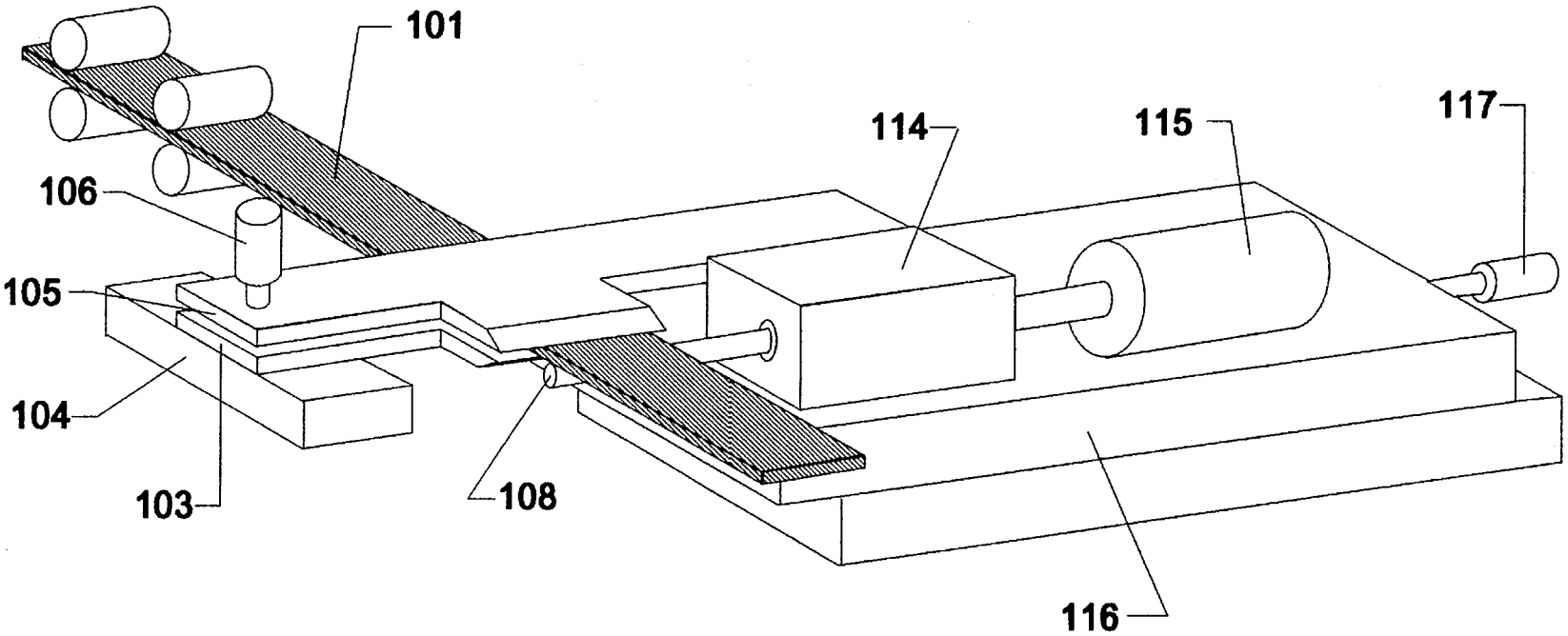
FIG. 5 depicts the principal electro-mechanical components of the bending mechanism, including the gripping jaws, bending mandrel, feed rollers, and associated parts.

A unique feature of this invention is illustrated in FIG. 5. The rotation assembly 114 for bending tool 108 together with rotation motor 115, stationary bar 103, and moveable bar 105, are all mounted on a lateral slide 116 moveable parallel to the axis of rotation by a suitable actuator 117 which may be an air cylinder. All of the other bender components are mounted rigidly to the main frame in a manner not shown in FIG. 5 for reasons of clarity. When actuator 117 is energized both bending bars 103 and 105 and bending tool 108 are withdrawn and disengaged completely from rule 101. While in the withdrawn position, bending tool 108 can be rotated without encountering rule 101 to a position 118 illustrated in FIG. 4F placing it on the opposite side of rule 101 when actuator 117 is released allowing the bending mechanism to re-engage rule 101. Note that clamp bars 103 and 105 and bending tool 108 are open-ended to enable them to be withdrawn. They receive support from stationary member 104 when they are in the bending position. Note also that stationary member 104 and actuator 106 are located outside of the bending plane so as not to obstruct the bending motions for complex rule shapes.

Another unique feature of the invention is the use of image analysis procedures to monitor the bending process and provide feedback information to improve its accuracy. The feedback principle is well known in the trade and widely used throughout industry. In essence, the procedure involves a careful measurement of the output of some operation, a comparison of that measurement with the desired output and utilization of the error so determined to modify the operation to reduce future errors. When correctly applied, feedback improves performance dramatically.

Figure 8A:
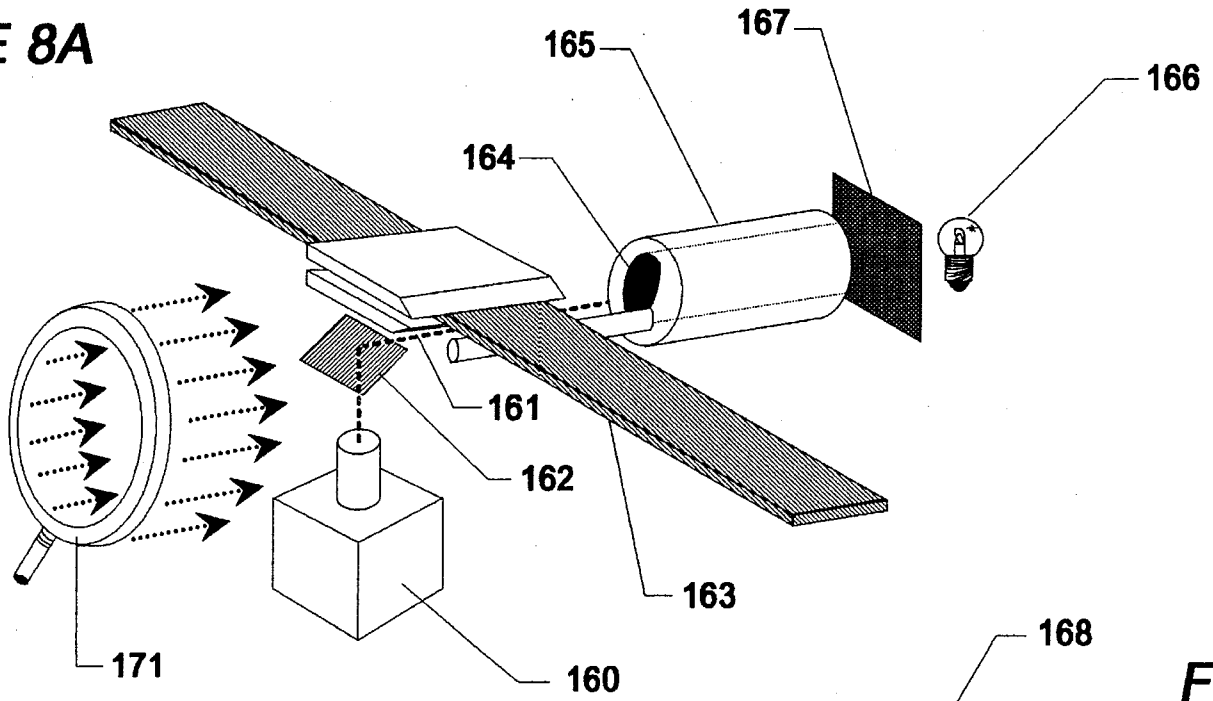
FIGS. 8A and 8B depict the video and optical parts of the system.
Figure 8B:
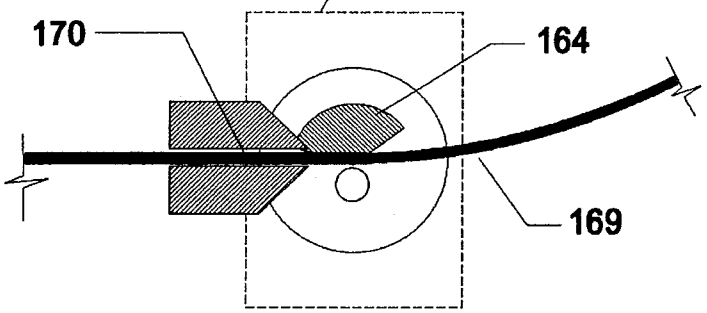

FIG. 8A illustrates the preferred optical system of the bender used to obtain an image of the bent rule in the vicinity of the last bend. Video camera 160 is mounted with its optic axis 161 parallel to the axis of the bending tool but with mirror 162 interposed for structural convenience. The camera is usually focused on the plane of cutting edge 163 of the rule but it may be focused differently. The rule is illuminated from behind in silhouette through an axial hole 164 in the rotatable shaft 165 of the bending mechanism by light source 166. Diffusing screen 167 placed between the light source and hole 164 is preferably used to improve the illumination. The dotted rectangle 168 in FIG. 8B represents the field of view of the camera. Axial hole 164 appears as a bright background within which a section of rule 169 at the exit of clamp 170 appears as a dark stripe of high contrast. The high contrast image enhances the extraction of useful information by the image processing procedure. The boundaries of the image are the edges of the body of rule not the cutting edge 163 which may have a slightly different shape especially on sharp bends. The body shape is precisely the information required since it must be inserted into the corresponding slots in the die base.

Front illumination by ring light 171 or equivalent can also be employed either separately or together with back illumination to illuminate the sloping sides of the rule near cutting edge 163 thereby enabling the precise shape of the cutting edge to be extracted from the image.

Various other arrangements of illumination and camera are also possible to view the rule obliquely or to enhance other features.

The image obtained by the video camera is digitized and stored within the memory of the control computer. This kind of image capture and digitalization is a well-developed technology, currently used in a variety of fields, including image enhancement of X-rays, aerial photographs, and the like. It is also used for edge detection in the manufacturing of integrated circuits. It is presently contemplated that the electronic subsystem used for image capture and digitalization in the present invention will be either the FF-2 Feature Finder, produced by Current Technology, Inc., of Durham, N.H., or the IDL16 frame grabber, produced by Catenary Systems, Inc., of St. Louis, Mo., together with the Victor Image Processing Library for Windows, V3.0, also produced by Catenary Systems, Inc. These systems provide the resolution and repeatability required for the present invention.

Figure 9:
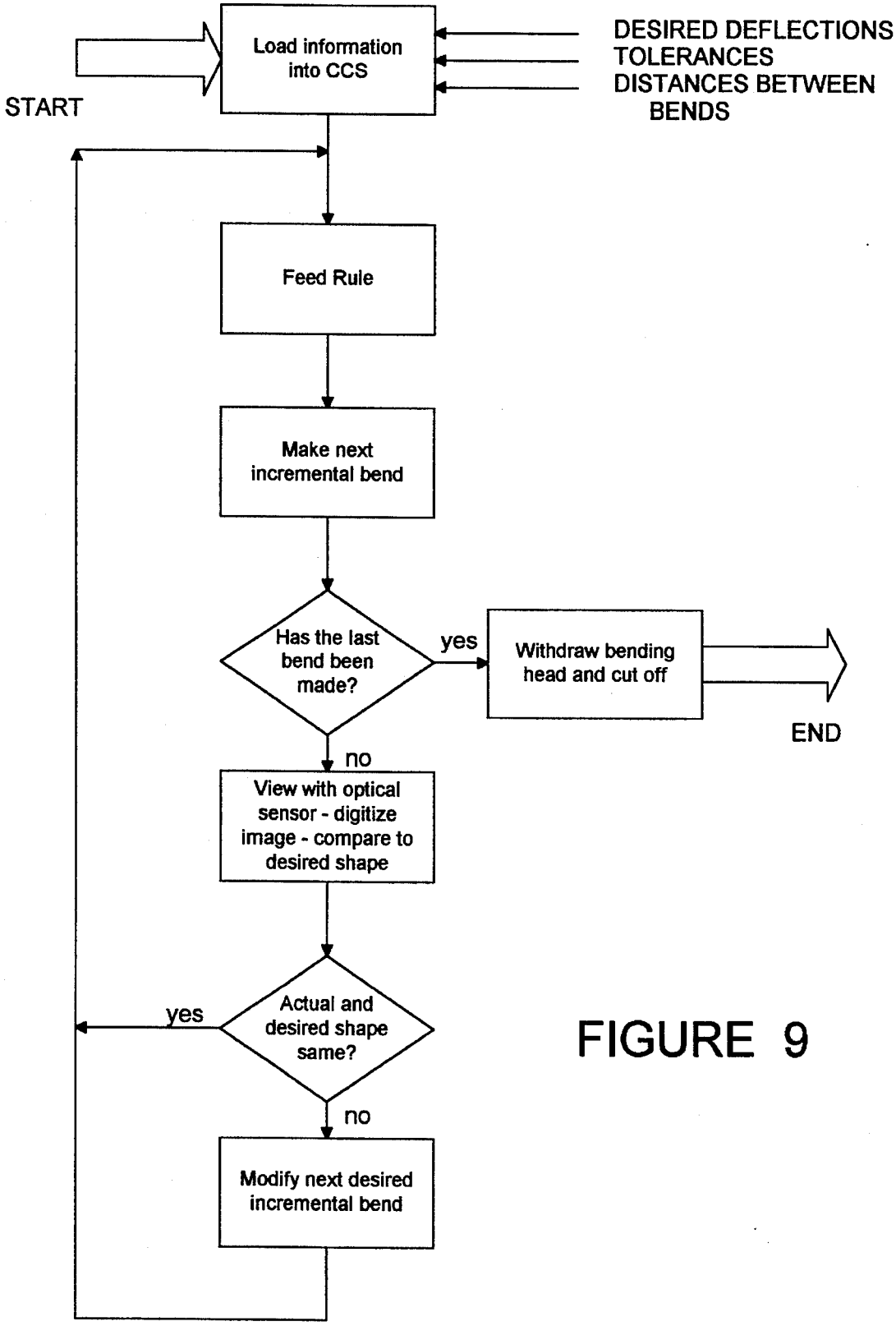
FIG. 9 depicts a control sequence of the system, as implemented in the computation and control subsystem of the invention, and illustrating the means by which the video-optics are integrated into the feedback portion of the computation and control system.

In addition to the products mentioned above, there is a vast library of computer algorithms well-known in the trade for processing a digitized image as described herein. The task at hand is relatively easy since we are seeking to measure only small deviations from a known shape. One of the many possible procedures is illustrated in FIG. 9. The digitized image is first processed to remove background signals and other irrelevant data. The clean image is then analyzed to obtain the xy coordinates of the best fitting smooth curve, which is the rule centerline. This data together with the corresponding data for the desired shape is then analyzed to obtain corrected values for the linear advance and bend angle of the next step of the bending sequence to compensate for any detected error. This feedback procedure overcomes essentially all of the unavoidable statistical variations in rule material and machine operations thereby producing a near perfect bend pattern.

Figure 6A:
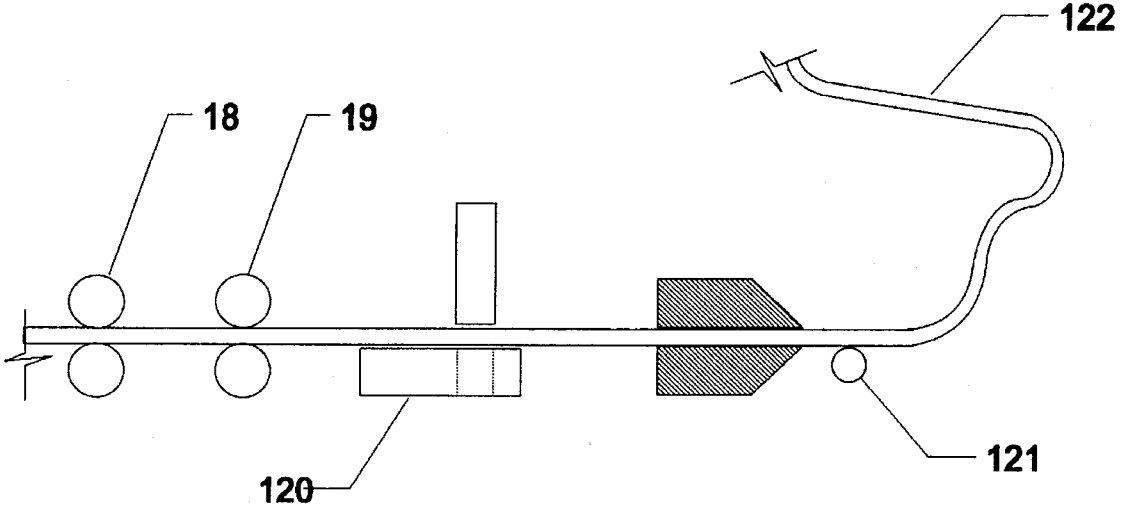
FIGS. 6A and 6B depict the interaction between the cutter-notcher and the bender, illustrating, in FIG. 6B, how the gripper is withdrawn prior to the cutting operation, and further illustrating how the cutting operation can be performed in close proximity to the final bend in the die.
Figure 6B:
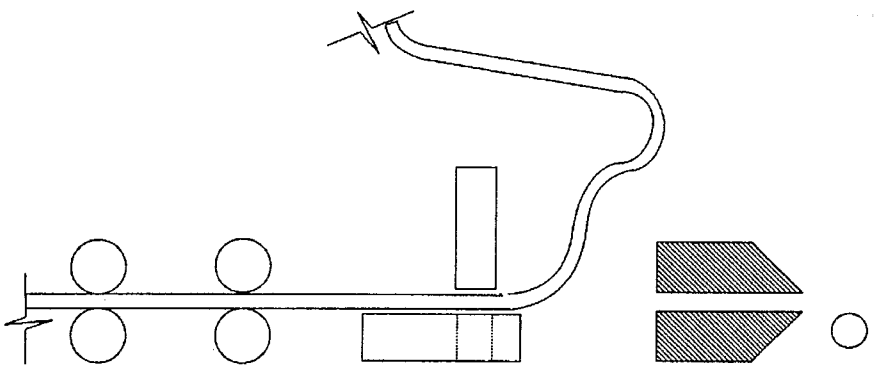

The disengagement procedure described with reference to FIG. 5 also provides still another unique feature of the invention illustrated in FIG. 6. FIG. 6A shows the essential elements of the complete system including measuring roller 18, main drive roller 19, cutting assembly 120 and bending assembly 121 as they would be disposed after completion of a specific bending pattern 122. When the bending mechanism is disengaged from the rule, main drive roller 19 can move the rule backwards to bring pattern 122 close to cutting assembly 120 as illustrated in FIG. 6B enabling the cut to be located close to the last bend in pattern 122. This feature avoids the troublesome procedure of trimming the end of the rule manually as a separate operation.

I claim:

1. A method of forming steel rule into a predetermined shape through a series of bending operations, comprising the steps of:

(a) feeding steel rule in a longitudinal direction under control of control means to a gripping device so that a desired point of said steel rule is located at an exit end of the gripping device and a portion of said steel rule protrudes from the exit of the gripping device;

(b) gripping said steel rule in said gripping device;

(c) performing a current bending operation by deflecting the protruding portion using deflecting means under control of said control means by a calculated amount to form a bend in the steel rule at the desired point;

(d) optically analyzing a profile of said steel rule at the protruding portion to determine using said control means an actual shape of the protruding portion at completion of said current bending operation;

(e) comparing said actual shape of the protruding portion to a desired shape for said current bending operation and determining a deviation from the desired shape;

(f) determining a calculated amount for a next bending operation at least on the basis of springback in the steel rule and a desired amount for the next bending operation and the deviation determined in step (e);

(g) feeding the steel rule so that a next desired point of said steel rule is located at the exit end of the gripping device and a portion of said steel rule protrudes from the exit end of the gripping device;

(h) gripping said steel rule in said gripping device;

(i) performing a current bending operation by deflecting the protruding portion using deflecting means under control of said control means by the calculated amount determined in step (f) to form a bend in the steel rule at the desired point; and, (j) returning to step (j) and continuing until the predetermined shape is achieved.

2. A method as claimed in claim 1 further comprising the steps of before said gripping step of loading a coil of said steel rule onto a feeder mechanism; and feeding said steel rule using said feeder mechanism under control of said control means from said coil to said gripping device.

3. A method as claimed in claim 1, further comprising the step before said gripping step of inputting elasticity data concerning said steel rule into said control means, wherein said control means calculates said amount and said next amount at least partially on the basis of the input elasticity data.

4. A method as claimed in claim 1, further comprising the step before said gripping step of inputting shape information concerning said predetermined shape into said control means, wherein said control means calculates said amount and said next amount at least partially on the basis of the input shape information.

5. A method as claimed in claim 1 further comprising the step, after said step (j), of cutting said steel rule at a position after a last bend.

6. A method as claimed in claim 5, wherein said cutting step comprises the steps of withdrawing said deflecting means and said gripping device from a path of said steel rule, and retracting said steel rule until a position to be cut is located at a cutting point of a cutter upstream, with respect to a direction of advancing said steel rule, of said deflecting means and said gripping means.

7. A method as claimed in claim 6, further comprising the step, before said gripping step, of notching said steel rule using said cutter under control of said control means.

8. A method of manufacture of steel rule dies wherein a steel strip is fed into a machine by strip feeding means, whose operation comprises, in the following order:

(a) inputting elasticity information describing the steel rule being used into a computation and control unit;

(b) inputting information representing the shape desired to be fabricated into the computation and control unit;

(c) calculating the location of the next bend to be made, the angle of said next bend, and the direction of said next bend, in the computation and control unit by use of a program which takes into account in its calculations the steel elasticity information and the shape information;

(d) advancing said steel strip by driving means through a linear displacement encoding means which provides a linear encoding displacement signal which accurately locates a point on said steel strip throughout the travel of said steel strip;

(e) gripping said steel strip firmly by gripping means, which has an input side, where said steel strip enters said gripping means, and an exit side, where said steel strip exits said gripping means, whereby said steel strip is gripped at said next bend location;

(f) bending said steel strip, by bending means, at said exit side of said gripping means in the amount, and in the direction, calculated by said computation and control unit;

(g) viewing the steel rule at the exit side of the gripping means by use of optical measuring means, thereby producing an electrical signal representative of the shape of the steel rule;

(h) feeding said electrical signal back to the computation and control unit;

(i) calculating the position, displacement, and direction of the next bend to be made, in the computation and control unit, taking into account said electrical signal, said steel elasticity information and said shape information;

(j) repeating said operation at clause (d) of this claim, until the die has been completely formed;

(k) withdrawing the bending means and gripping means from the steel rule;

(m) moving the steel rule to the cutting location; and (l) cutting the steel rule by die cutting means at the last position calculated by the computation and control unit.

9. A method as claimed in claim 8, further comprising, in order:

(a) feeding the steel rule through a notching means during the die forming process;

(b) controlling the notching and cutting means by means of the computation and control unit; and (c) cutting the die at the last position calculated by the computation and control unit.

10. A method as claimed in claim 9, further comprising controllably moving said steel strip in its longitudinal direction, whereby the width of the notch produced is varied by multiple, overlapping notching operations.

11. A method as claimed in claim 9, further comprising controllably moving the notching and cutting means in a direction perpendicular to the long axis of said steel strip, and notching said steel strip, whereby the depth of the notch is varied.

12. A method as claimed in claim 8, further comprising encoding said position by means of a roller attached to a shaft of a digital rotary encoder.

13. A method as claimed in claim 8, further comprising gripping by means of jaws that are mechanically closed on said steel strip and hold said steel strip, said jaws being tapered to allow bends in excess of 130 degrees.

14. A method as claimed in claim 13, further comprising bending by means of a mandrel which is driven by mandrel driving means and where said mandrel is withdrawn, then concentrically rotated about an axis in close proximity to the exit end of said gripping means, and then reinserted, so that said mandrel may be located on either side of the metal rule.

15. A method as claimed in claim 14, wherein the gripping and bending means may be withdrawn from proximity to the steel rule, so that said cutting means may be applied without interference from said gripping and bending means.

16. A method as claimed in claim 13, further comprising bending by means of a mandrel which is driven by mandrel driving means and where said mandrel is withdrawn, then eccentrically rotated about an axis in close proximity to the exit end of said gripping means, and then reinserted, so that said mandrel may be located on either side of the metal rule.

17. A method as claimed in claim 16, wherein the gripping and bending means may be withdrawn from proximity to the steel rule, so that said cutting means may be applied without interference from said gripping and bending means.

18. A method as claimed in claim 8, wherein the optical means includes video sensing means.

19. An apparatus for forming steel rule into a predetermined shape through a series of bending operations, comprising:

control means for controlling operation of said apparatus, said control means including a memory for storing data for forming a predetermined shape including at least a table containing a desired deflection amount for each bending operation and a distance between bending operation;

gripping means for gripping said steel rule under control of said control means so that a portion of said steel rule protrudes from an exit end of said gripping means;

means for deflecting said protruding portion relative to the exit end of the gripping means by a calculated amount under control of said control means;

means for feeding said steel rule to said gripper means in a longitudinal feed direction in amount determined by said control means; and optical means arranged to view said protruding portion and produce and supply to said control means a signal indicative of an actual shape of said protruding portion for each current bending operation;

wherein said control means includes means for determining an actual deflection of said protruding portion from said signal and comparing aid actual deflection to the stored desired deflection for the current bending operation, and determining said calculated amount for a bending operation immediately subsequent to the current bending operation, said calculated amount being based on a stored desired deflection for said subsequent bending operation and a deviation in the current bending operation between the actual deflection and the desired deflection of the current bending operation.

20. Apparatus as claimed in claim 19, further comprising means for inputting elasticity data concerning said steel rule into said memory of the control means, wherein said control means determines said calculated amount further on the basis of the input elasticity data.

21. Apparatus as claimed in claim 19, further comprising cutting means under control of said control means for cutting said steel rule, said cutting means located adjacent said gripping means longitudinally opposite said deflecting means, the cutting means being laterally movable from a rest position laterally adjacent the steel rule to a cutting position at the steel rule.

22. Apparatus as claimed in claim 19, further comprising:

carriage means supporting said deflecting means and said gripping means, said carriage means being laterally movable to selectively move said deflecting means and said gripping means from a first position in engagement with said steel rule to a second position out of engagement with said steel rule, and wherein, said means for longitudinally feeding said steel rule is controllable for movement selectively in a forward and a reverse direction to position said steel rule for cutting a selected location.

23. Apparatus as claimed in claim 22, wherein said cutting means is movable to a position for notching said steel rule at a desired location under control of said cutting means.

24. Apparatus as claimed in claim 21, wherein the cutting means comprises die cutting means.

25. Apparatus as claimed in claim 23, wherein the cutting means includes a die having a shape wherein a notch of predetermined width and depth is producible by a plurality of overlapping notches formed in the steel rule by selective lateral positioning of the cutter and selective longitudinal positioning of the steel rule.

26. Apparatus as claimed in claim 24, wherein said die cutting means includes a die having a tapered section to cut the steel rule with a mitered end.

27. Apparatus as claimed in claim 19, further comprising linear displacement encoding means to provide a signal indicating a location relative to the apparatus of the selected point on the steel rule, having a roller attached to a shaft of the digital rotary encoder.

28. Apparatus as claimed in claim 19, wherein the gripping means includes opposable jaws having outer surfaces that are tapered to coverage toward the exit end to allow bends in excess of 130 degrees.

29. Apparatus as claimed in claim 19, deflecting means includes a bending rod mounted on a rotatable mandrel the bending rod extending perpendicular to the longitudinal feed direction and mounted eccentrically to an axis of rotation of said mandrel and said axis of rotation being located substantially at the exit end of said gripping means, wherein rotation of the mandrel causes the bending rod to push against the steel rule to bend the steel rule.

30. Apparatus as claimed in claim 29, further comprising means for laterally moving the deflecting means parallel to said axis of rotation away from the steel rule wherein when in said position away from the steel rule, said mandrel is rotatable about said axis said bending rod is selectively located on either side of the steel rule.

31. Apparatus as claimed in claim 19, wherein the optical means includes a video camera positioned to capture an image of said protruding portion on a viewing axis perpendicular to the longitudinal feed direction and parallel to a deflecting axis to obtain a profile image of said protruding portion.

32. Apparatus as claimed in claim 19, wherein the control means includes means for determining an amount to feed the steel rule after the current bending operation based on the stored distance between the current bending operation and the immediately subsequent bending operation and a distance calculated from the deviation in the current bending operation between the actual deflection and the desired deflection of the current bending operation.

33. The apparatus as claimed in claim 31, further comprising illumination means to illuminate the steel rule for imaging by the video camera, the illumination means including a light source positioned to direct light parallel to the deflecting axis through a hole in the mandrel.

34. The apparatus as claimed in claim 31, wherein said control means further comprises means for digitizing the profile image of the steel rule, and wherein said means for determining an actual deflection of said protruding portion converts said digitized profile image into shape information comparable to said stored predetermined shape data.

* * * * *